US008413293B2

(12) United States Patent
Dyck et al.

(10) Patent No.: US 8,413,293 B2
(45) Date of Patent: Apr. 9, 2013

(54) VACUUM CLEANER COMPRISING A DUST COLLECTION CHAMBER SEALABLE BY A COVER AND A TILTABLE DUST BAG RECEPTACLE

(75) Inventors: Sandra Dyck, Bielefeld (DE); Arne Sauerland, Herford (DE); Markus Thamm, Leopoldshoehe (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 12/989,823

(22) PCT Filed: Apr. 17, 2009

(86) PCT No.: PCT/EP2009/002816

§ 371 (c)(1), (2), (4) Date: Oct. 27, 2010

(87) PCT Pub. No.: WO2009/132780

PCT Pub. Date: Nov. 5, 2009

(65) Prior Publication Data

US 2011/0041283 A1 Feb. 24, 2011

(30) Foreign Application Priority Data

Apr. 30, 2008 (DE) ..... 10 2008 021 789

(51) Int. Cl.
*A47L 9/14* (2006.01)

(52) U.S. Cl. ..... 15/347; 15/327.2; 15/DIG. 8; 55/369; 55/378; 55/DIG. 2; 55/DIG. 3

(58) Field of Classification Search ..... 15/327.2, 15/319, 339, 347, 352, DIG. 8; 55/369, 378, 55/DIG. 2, DIG. 3; *A47L 9/14*
See application file for complete search history.

(56) References Cited

U.S. PATENT DOCUMENTS

| | | | | |
|---|---|---|---|---|
| 5,907,889 | A * | 6/1999 | Fukushima et al. | 15/339 |
| 6,886,215 | B2 * | 5/2005 | Dodson et al. | 15/339 |
| 2004/0163205 | A1 | 8/2004 | Albert et al. | |
| 2005/0022335 | A1 | 2/2005 | Gerth et al. | |

FOREIGN PATENT DOCUMENTS

| | | | |
|---|---|---|---|
| DE | 39 20 313 | A1 | 1/1991 |
| DE | 196 51 027 | A1 | 5/1998 |
| DE | 101 42 509 | A1 | 3/2003 |
| DE | 103 34 894 | B3 | 10/2004 |
| DE | 10 2004 040981 | A1 | 3/2006 |

(Continued)

OTHER PUBLICATIONS

International Search Report for PCT/EP2009/002816 mailed Jul. 13, 2009.

*Primary Examiner* — David Redding
(74) *Attorney, Agent, or Firm* — Leydig, Voit & Mayer, Ltd.

(57) ABSTRACT

A vacuum cleaner includes a dust collection chamber, a cover configured to close the dust collection chamber and a mount for a dust bag disposed in the dust collection chamber. The mount is pivotable about a pivot axis from a first position blocking a closure path of the cover to a second position in which the mount does not block closure path of the cover. The mount is pivotable into the second position upon receiving of the dust bag. The location of the mount in the first and second positions and a position of the center of gravity of the mount relative to the pivot axis are configured so as to automatically pivot the mount from the second position to the first position when the dust bag is removed from the mount and when the vacuum cleaner is disposed in a normal operating position on a substantially level surface.

3 Claims, 3 Drawing Sheets

FOREIGN PATENT DOCUMENTS

| | | | |
|---|---|---|---|
| EP | 0 044 501 | A1 | 1/1982 |
| EP | 1 774 886 | A1 | 4/2007 |
| GB | 1 211 782 | A | 11/1970 |
| WO | WO 2006/021482 | A1 | 3/2006 |

* cited by examiner

VACUUM CLEANER COMPRISING A DUST COLLECTION CHAMBER SEALABLE BY A COVER AND A TILTABLE DUST BAG RECEPTACLE

CROSS REFERENCE TO RELATED APPLICATIONS

This application is a U.S. National Phase application under 35 U.S.C. §371 of International Application No. PCT/EP2009/002816, filed on Apr. 17, 2009, and claims benefit to German Patent Application No. DE 10 2008 021 789.1, filed on Apr. 30, 2008. The International Application was published in German on Nov. 5, 2009 as WO 2009/132780 A1 under PCT Article 21 (2)

FIELD

The present invention relates to a vacuum cleaner, and particularly relates to a vacuum cleaner having a dust collection chamber which can be closed by a cover and a mount for a dust bag.

BACKGROUND

EP 1 774 886 A1 describes a vacuum cleaner having a dust collection chamber which can be closed by a cover.

For vacuum cleaners, and particularly for canister vacuum cleaners, in which a dust bag is used for dust separation, it is desirable to inform the user if he or she forgets to insert the dust bag into its mount. For this purpose, the vacuum cleaners described in DE 103 34 894 B3, DE 196 51 027 A1, DE 101 42 509 A1 include a pivotable mount which is designed such that when no dust bag is in place, it assumes a first position in which it blocks the closure path of the cover and that when a dust bag is inserted, it pivots into a second position in which the cover is no longer prevented from being closed. These vacuum cleaners use flat or torsion springs to pivot the mount into the first position. The installation of such springs is very costly and labor-intensive.

SUMMARY

In an embodiment, the present invention provides a vacuum cleaner in which the mount is easy to install.

In an embodiment, the present invention provides a vacuum cleaner including wheels defining a surface at a lowermost point of the wheels when the vacuum cleaner is in a normal operating position. The vacuum cleaner includes a dust collection chamber and a cover configured to close the dust collection chamber having a projecting detent element. A mount for a dust bag is disposed in the dust collection chamber and is pivotable, by receiving of the dust bag in the mount, about a pivot axis from a first position blocking a closure path of the cover to a second position in which the mount does not block closure path of the cover. The pivot axis lies in a plane that is perpendicular to the defined surface and a center of gravity of the mount is disposed on a side of the plane that is opposite the projecting detent element so that the mount is automatically pivotable from the second position to the first position when the dust bag is removed from the mount when the vacuum cleaner is disposed in a normal operating position on the surface and the surface is substantially level.

BRIEF DESCRIPTION OF THE DRAWINGS

An exemplary embodiment of the present invention is shown in the drawings in a purely schematic way and will be described in more detail below. In the drawing.

DETAILED DESCRIPTION

In an embodiment, the present invention provides a vacuum cleaner having a dust collection chamber which can be closed by a cover and a mount for a dust bag, the mount being disposed in the dust collection chamber and being pivotable, by insertion of the bag, from a first position blocking the cover closure path into a second position not blocking the cover closure path.

In an embodiment, the mount is movable into the first position without requiring any component which would be subject to wear and functional deterioration.

Figure 1:
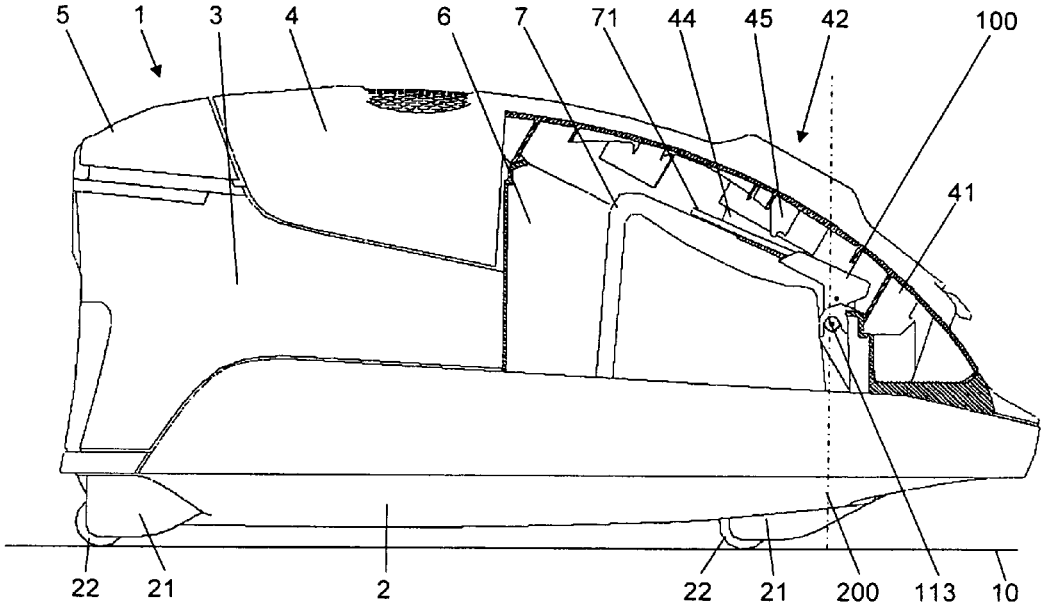
FIG. 1 is a partially sectional side view of a vacuum cleaner containing a dust bag.

Referring to FIG. 1, a vacuum cleaner 1 designed in accordance with the present invention is illustrated using the example of a canister vacuum cleaner. Vacuum cleaner 1 has a housing which, as is generally known, includes a lower housing part 2, an upper housing part 3, a cover 4, and a cap 5. Lower housing part 2 is provided with runners 21 and wheels 22 rotatably mounted thereto, so that vacuum cleaner 1 can be moved in any desired direction over the surface 10 to be cleaned. FIG. 1 shows vacuum cleaner in its normal position of use; i.e., supported on an at least approximately level surface 10 by at least three wheels 22. Bottom housing part 2 and upper housing part 3 together form, inter alia, a dust collection chamber 6 for receiving a dust bag 7. Dust collection chamber 6 can be closed hermetically by cover 4. To this end, cover 4 is pivotally mounted to cap 5. A locking device 41 ensures that cover 4 remains in the closed position.

Figure 2:
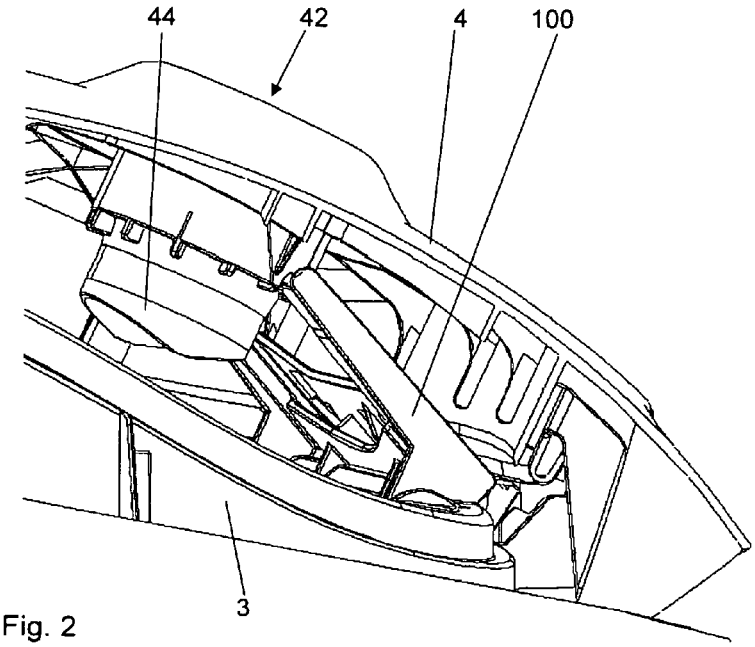
FIG. 2 is a perspective view showing the interior of the vacuum cleaner in the region of the dust bag mount.
Figure 3:
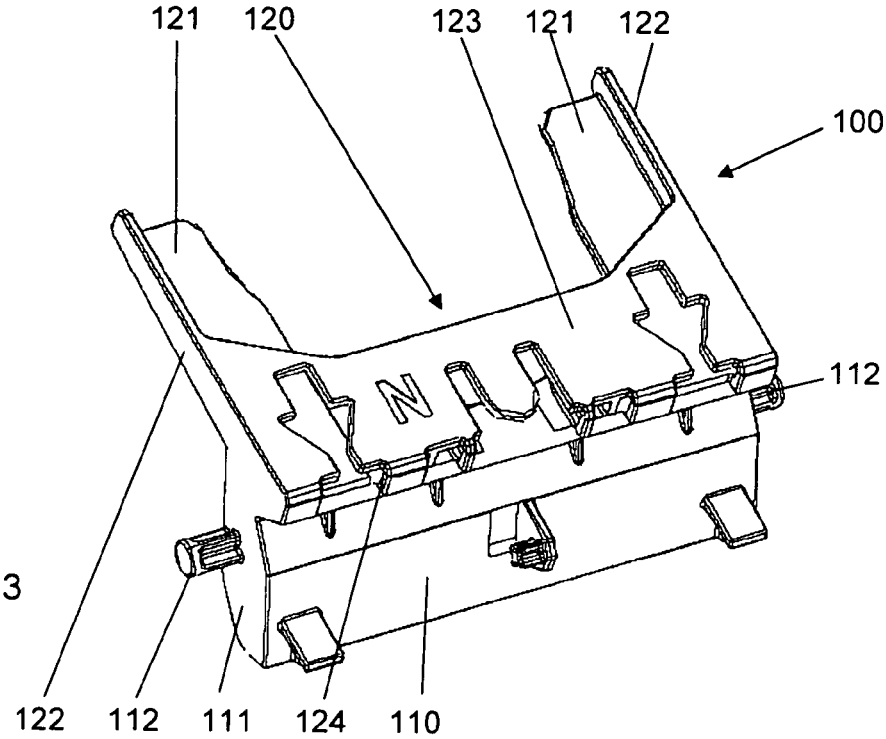
FIG. 3 is an isolated view of the dust bag mount.
Figure 4:
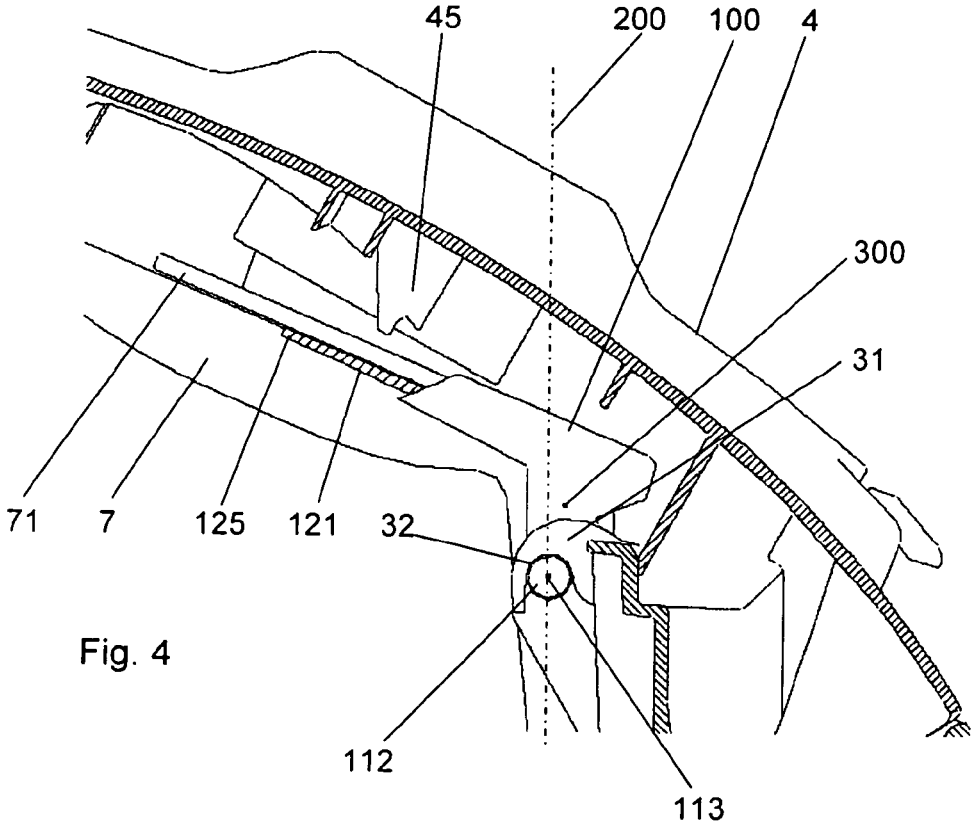
FIG. 4 is a view of a portion of FIG. 1, illustrating the region of the dust bag mount.

Cover 4 is provided with an opening 42 allowing dust-laden air to be introduced into dust collection chamber 6 and then into dust bag 7. A suction hose is attached to said opening in a generally known manner. Cover opening 42 is surrounded on the inside by a tubular intake port 44, which is inserted into the interior of the dust bag when cover 4 is closed. Since tubular port 44 is in close contact with bag 7, a dust bag collar 71 having an opening is provided in this region to surround tubular port 44 with a suitable seal. Therefore, it should be ensured that the opening of dust bag collar 71 is in a defined position with respect to tubular port 44 while cover 4 is being closed. This is achieved by inserting dust bag collar 71 into a dust bag mount 100. In FIG. 2, mount 100 is shown installed inside the vacuum cleaner, while in FIG. 3, it is shown as a detail. The dust bag mount is formed as one piece from plastic and includes a holding portion 110 and a pocket 120. Holding portion 110 has two side faces 111, each having a short extension 112 formed thereon. As can be seen in FIG. 4, these extensions are rotatably inserted into two bearing shells 31 of upper housing part 3. Receiving openings 32 of the bearing shells are adapted to surround extensions 112 over an angle slightly greater than 180° so as to captively yet pivotably support mount 100. The pivot axis coincides with the centerline of the two extensions 112 and is denoted by 113 in FIGS. 1 and 4 through 6.

Pocket 120 extends at an angle of about 110° from the holding portion into the interior of dust collection chamber 6.

The pocket includes a covering surface 123 and two guide surfaces 121 which, together with extensions 122 of the two side faces 111, each form an angular guide. To insert dust bag 7, dust bag collar 71 is slid along guide surfaces 121 underneath covering surface 123 until it abuts against a stop 124.

Figure 5:
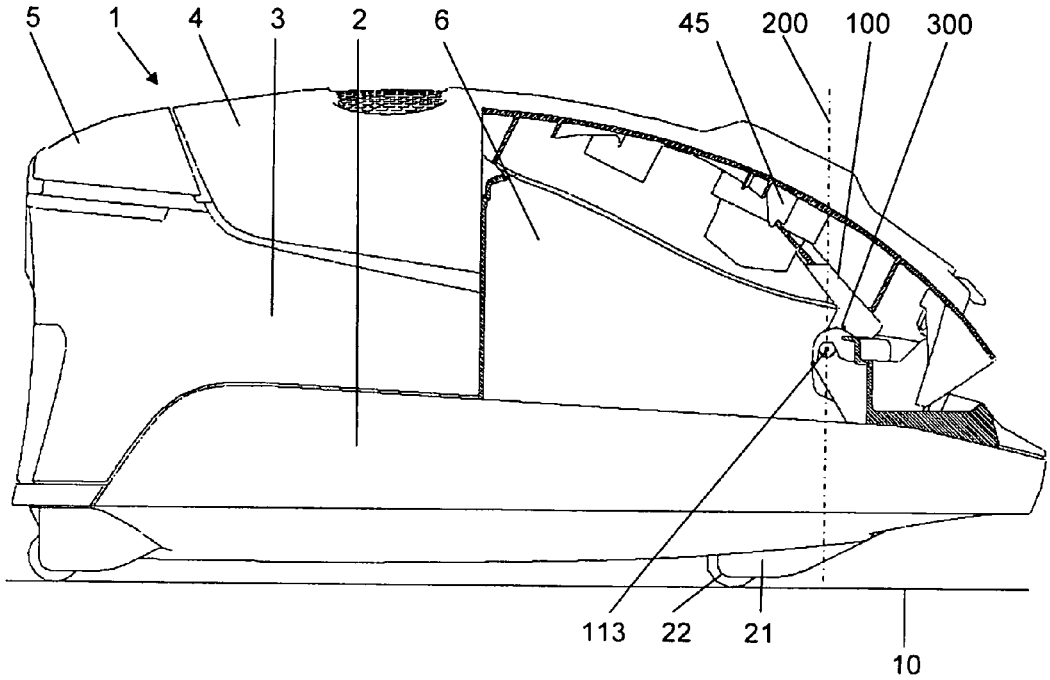
FIG. 5 is a partially sectional side view showing the vacuum cleaner without a dust bag.
Figure 6:
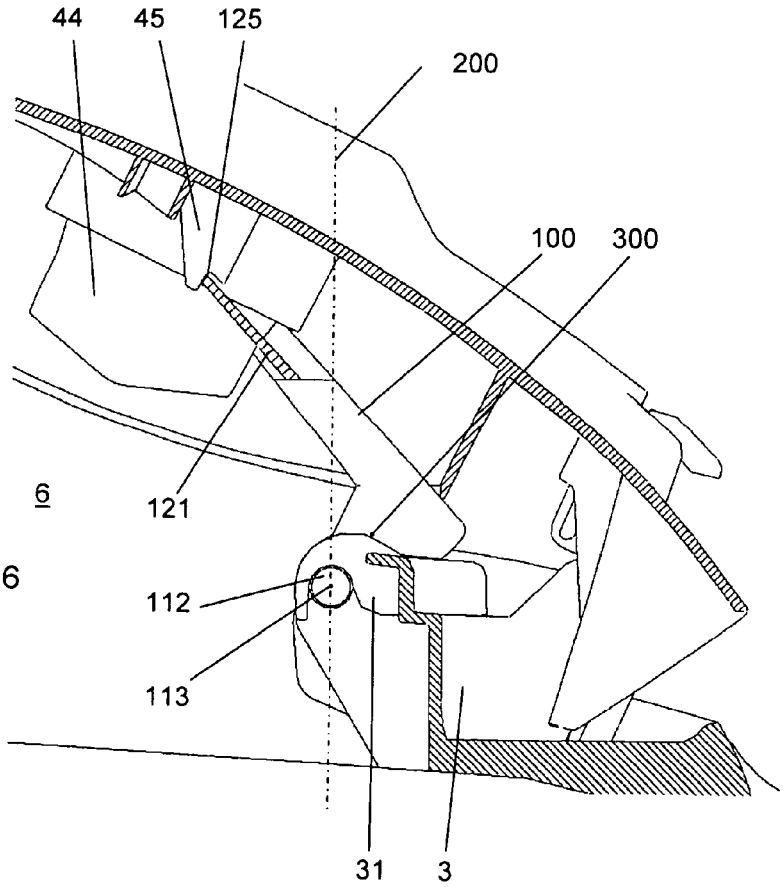
FIG. 6 is a view of a portion of FIG. 5, illustrating the region of the dust bag mount.

When comparing FIGS. 1 and 4 with FIGS. 5 and 6, it can be seen that vacuum cleaner 1 designed in accordance with the present invention is provided with means to prevent cover 4 from being closed when no dust bag 7 is present in mount 100. To achieve this, mount 100 is adapted to automatically pivot into a first position (see FIGS. 5 and 6) when no dust bag is in place, in which first position end 125 of at least one guide surface 121 engages with a projecting detent element 45 formed on cover 4. This prevents cover 4 from pivoting into its closed position and indicates to the user that bag 7 is not in place. Upon insertion of bag 7, mount 100, along with dust bag collar 71 placed therein, pivots into the second position shown in FIGS. 1 and 4, permitting closure of the cover.

Automatic movement into the locking first position is achieved by suitably dimensioning mount 100 so that its center of gravity, as seen from projecting detent element 45, is located beyond a plane which is perpendicular to the surface 10 defined by the lowermost points of the wheels and in which pivot axis 113 of mount 100 lies. In FIGS. 1 and 4 through 6, this plane is indicated by dashed line 200, and the projection of the center of gravity onto the side face is indicated by dot 300. If no dust bag 7 is inserted in pocket 120, center of gravity 300 creates a torque causing mount 100 to pivot in a clockwise direction as seen in the aforementioned figures. As a result, mount 100 moves into the first position shown in FIGS. 5 and 6, so long as the vacuum cleaner 1 is in its normal position of use. Insertion of dust bag collar 71 into pocket 120 causes the center of gravity of the overall system (mount 100 plus dust bag 7) to be shifted to the other side of plane 200. As a result, mount 100 pivots in a counterclockwise direction into the second position shown in FIGS. 1 and 4. It can be seen that center of gravity 300 of mount 100 is still located beyond plane 200, so that removal of dust bag collar 71 from pocket 120 causes mount 100 to automatically pivot back into its first position without application of any additional force, such as the force of a spring or the like.

While the invention has been particularly shown and described with reference to preferred embodiments thereof, it will be understood by those skilled in the art that various changes in form and details may be made therein without departing from the spirit and scope of the invention.

What is claimed is:

1. A vacuum cleaner comprising:

wheels defining a surface at a lowermost point of the wheels when the vacuum cleaner is in a normal operating position;

a dust collection chamber;

a cover configured to close the dust collection chamber, the cover including a projecting detent element; and a mount for a dust bag, the mount being disposed in the dust collection chamber and being pivotable, by receiving of the dust bag in the mount, about a pivot axis from a first position blocking a closure path of the cover to a second position in which the mount does not block closure path of the cover, the pivot axis lying in a plane that is perpendicular to the defined surface, a center of gravity of the mount being disposed on a side of the plane that is opposite the projecting detent element so that the mount is automatically pivotable from the second position to the first position when the dust bag is removed from the mount when the vacuum cleaner is disposed in the normal operating position on the surface and the surface is substantially level.

2. The vacuum cleaner as recited in claim 1, wherein the mount includes a pocket configured to receive a collar of a dust bag.

3. The vacuum cleaner as recited in claim 1, wherein the mount is configured such that a weight of the dust bag when received in the mount provides a torque on the mount so as to hold the mount in the second position.

* * * * *

UNITED STATES PATENT AND TRADEMARK OFFICE

CERTIFICATE OF CORRECTION

PATENT NO. : 8,413,293 B2
APPLICATION NO. : 12/989823
DATED : April 9, 2013
INVENTOR(S) : Dyck et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 343 days.

Signed and Sealed this
Fourth Day of June, 2013

Teresa Stanek Rea
*Acting Director of the United States Patent and Trademark Office*